United States Patent [19]

McCleerey

[11] 4,456,317

[45] Jun. 26, 1984

[54] COMMONING STRIP

[75] Inventor: Earl W. McCleerey, Mechanicsburg, Pa.

[73] Assignee: AMP Incorporated, Harrisburg, Pa.

[21] Appl. No.: 473,885

[22] Filed: Mar. 10, 1983

[51] Int. Cl.[3] ..... H01R 4/66; H01R 31/08

[52] U.S. Cl. ..... 339/14 R; 339/19; 339/143 R

[58] Field of Search ..... 339/14 R, 14 L, 19, 339/143 R, 217 S, 222, 97 R, 99 R, 176 M

[56] References Cited

U.S. PATENT DOCUMENTS 4,215,910 8/1980 Walter .
4,285,561 8/1981 Chow ..... 339/14 R
4,352,531 10/1982 Gutter .

FOREIGN PATENT DOCUMENTS 43200 1/1982 European Pat. Off. ..... 339/217 S

*Primary Examiner*—Eugene F. Desmond
*Assistant Examiner*—Steven C. Bishop
*Attorney, Agent, or Firm*—Russell J. Egan

[57] ABSTRACT

A commoning strip for effecting an interconnect between closely spaced terminals, each of which utilizes an insulation displacing conductor engagement which does not allow the addition of a further conductor, is formed of a strip of conductive material having a plurality of depending tabs, each tab being received between a pair of closely spaced flanges of an associate terminal to effect electrical and mechanical connection therewith. The strip also includes means to fixedly secure it to a connector housing carrying the terminals.

4 Claims, 4 Drawing Figures

COMMONING STRIP

The present invention relates to a method and device for commoning terminals of an electrical connector and in particular to a connector having terminals utilizing insulation displacing terminals on close center line spacing, which spacing does not allow room for multiple interconnects.

There are many instances when it is necessary to common two or more terminals of an electrical connector. However, in many connectors, because of the high density array of the terminals and the type of interconnection between the terminals and the conductors, there is frequently not enough room to insert commoning means or to include some kind of a jumping cable between terminals using the conductor engaging portions of the terminals.

The present invention constitutes an addition to the electrical connector described in my U.S. patent application Ser. No. 163,915 filed June 17, 1980.

The present invention pertains to a means to common terminals mounted in a housing in a closely spaced arrangement with each terminal having an insulation displacing conductor engaging portion. The subject system is used in connection with an electrical connector having a housing formed of rigid insulative material with a plurality of terminal passages extending between a mating face and a terminating face. Each of the passages is keyhole shaped in transverse section and is intersected by a slot intermediate the ends thereof. Each terminal mounted in the connector has a mating portion directed toward the mating face and an insulation displacing conductor engaging portion exposed in the termination portion of the housing. Each terminal also includes a pair of first flanges which extend normally from the axis of the terminal and each has at its free end a rearwardly directed diverging second flange, the axes of the second flanges define a plane parallel to the axis of the terminal. The subject bussing system includes a strip form conductor having a plurality of depending contact tabs spaced so as to be aligned with the transverse slots in the housing, each contact tab being received in mechanical and electrical engagement between the first flanges of a respective terminal. The strip also includes a plurality of locking tabs depending from an edge portion of the strip and spaced to lockingly engage respective portions of the connector housing.

An embodiment of the present invention will now be described by way of example with reference to the accompanying drawings in which.

Figure 1:
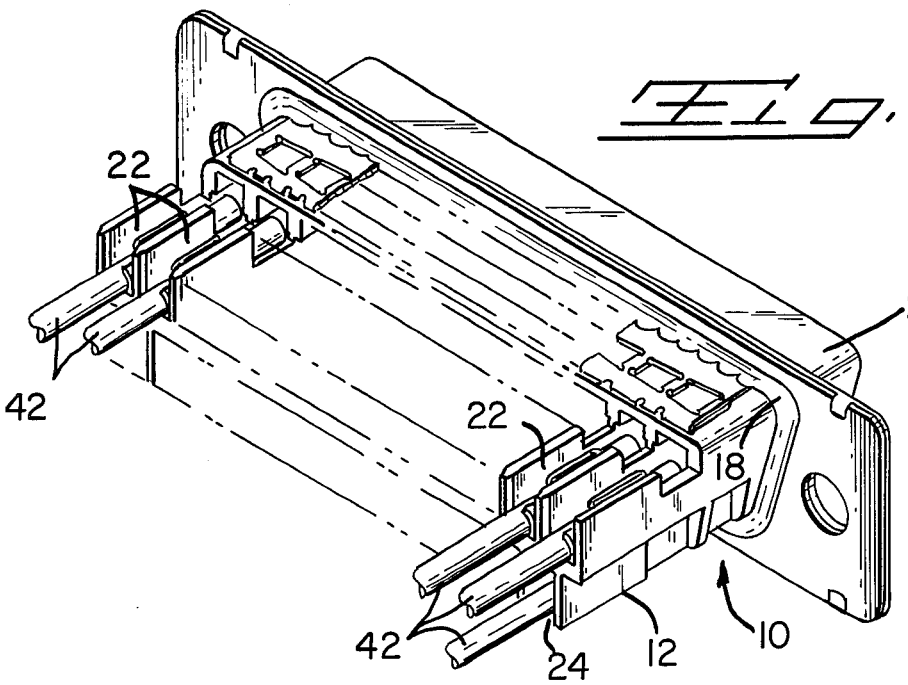
FIG. 1 is a rear perspective view of a connector incorporating the subject invention.
Figure 2:
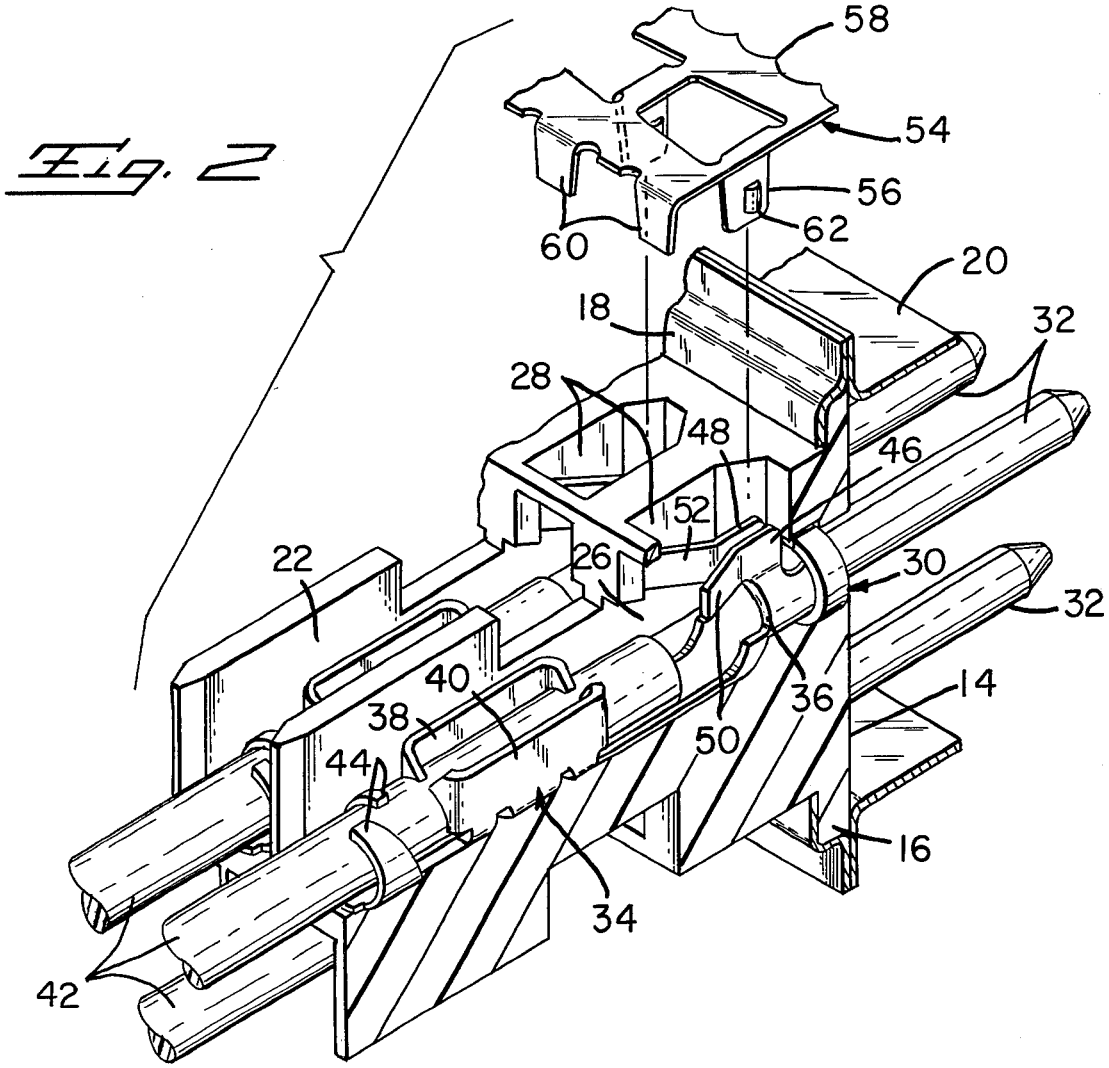
FIG. 2 is an exploded perspective fragment, partially in section, of the connector of FIG. 1 and the subject invention.

The subject invention is shown in the Figures in combination with an electrical connector housing and terminal of known type. The connector 10 has a housing 12 formed of rigid insulative material with a mating face 14 surrounded by an integral peripheral flange 16. A two piece metal flange and shroud 18, 20 are secured to the flange 16 and enclose the mating face. The rear portion of the connector housing 12 is formed with a plurality of parallel adjacent channels 22, 24 which are arranged in a pair of back-to-back rows directed outwardly oppositely from each other. The housing 12 is also provided with a plurality of terminal passages 26 each of which extends from a respective mating channel 22, 24 to the mating face 14. Each terminal passage 26 has a rear portion which has a key hole shaped, in transverse profile, and is intersected by a profiled transverse slot 28.

Each terminal 30 is stamped and formed from conductive metal stock and has a mating end 32, a conductor engaging rear portion 34, and an intermediate retention portion 36. The mating end 32 of each terminal 30 can be either a pin, as shown, or a socket. The conductor engaging rear portion 34 is formed by a pair of sidewalls 38, 40 spaced apart a distance slightly greater than the diameter of the conductor 42 to be received therein. The end portions of the sidewalls 38, 40 are inwardly bent to define therebetween a pair of insulation displacing conductor engaging slots. The terminal 30 is also provided with a pair of crimp ears 44 which engage the insulation of conductor 42 to provide both strain relief and retention of the conductor in the insulation displacing portion of the terminal. The terminal retention portion 36 includes a pair of flanges 46, 48 which extend normally from the axis of the terminal 30 and parallel to each other with each flange having on its free end a rearwardly directed lance 50, 52, the lances being perpendicular to their respective flanges and diverging from one another so as to define a plane parallel to and spaced from the axis of the terminal 30.

Figure 3:
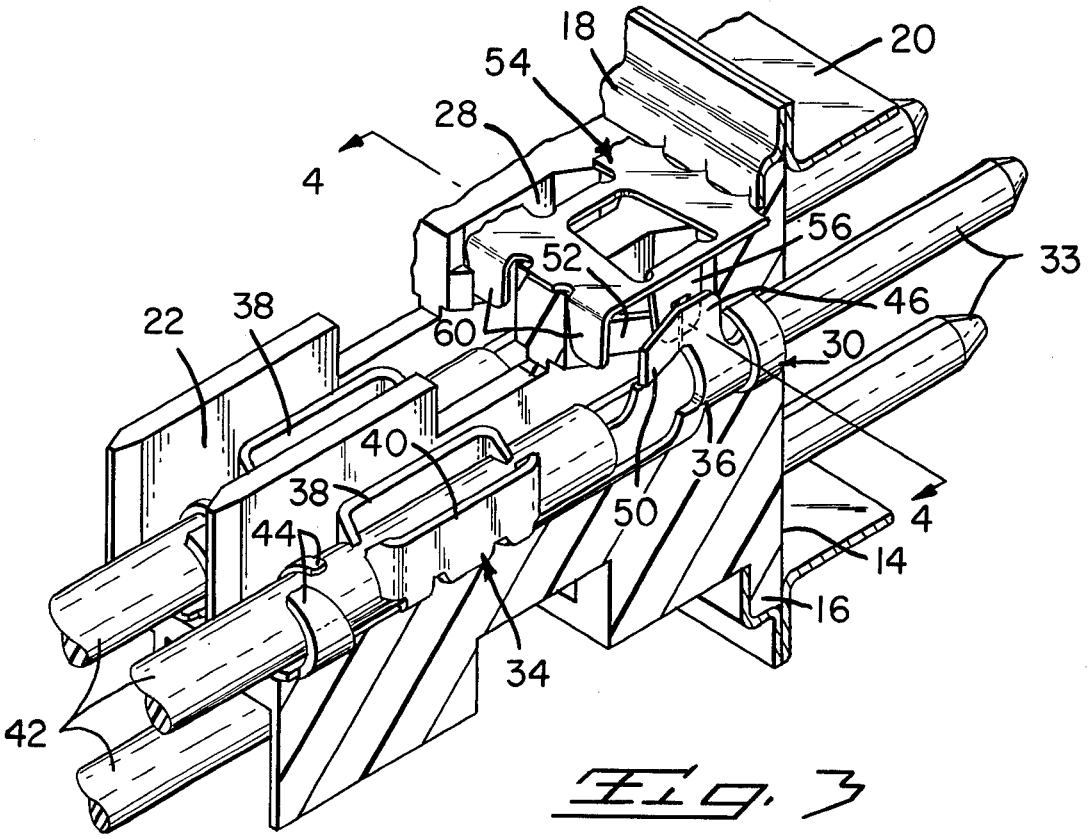
FIG. 3 is a view similar to FIG. 2 showing the subject invention in a fully assembled condition.
Figure 4:
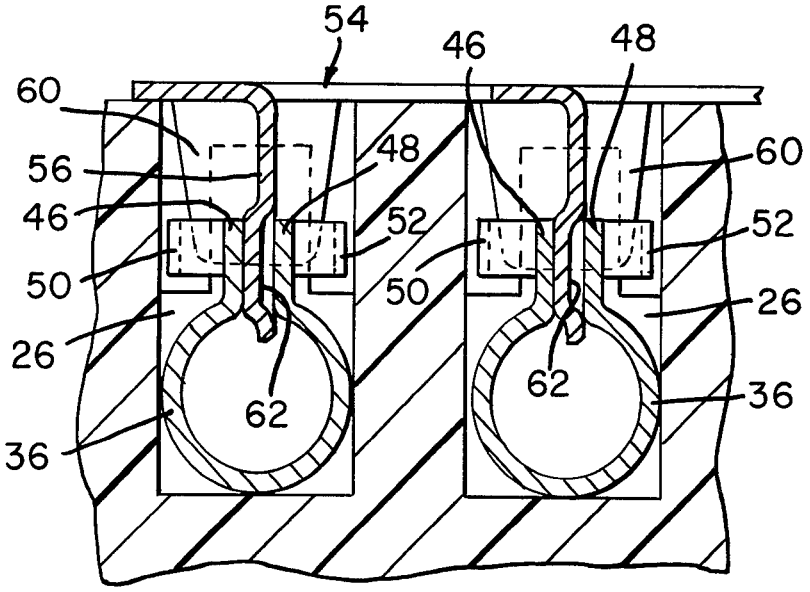
FIG. 4 is a section taken along line 4—4 of FIG. 3.

The subject invention is formed by an elongated strip 54 of conductive material having a plurality of contact tabs 56 depending therefrom in spaced relation, the spacing of the contact tabs 56 equalling the spacing between the terminals 30 of the associated connector 10. One edge of strip 54 is profiled with a series of points 58 so that it may bitingly engage against the flange 18. The strip 54 also has a plurality of locking tabs 60 depending from an opposite edge to extend over a rear portion of the housing 12 to help secure the strip 54 in place. The contact tabs 56 are received between the flanges 46, 48 of the respective terminals 30 and serve to common terminals together, as best shown in FIGS. 3 and 4. It should be noted that the contact tabs 56 are preferably each provided with a dimple 62 so as to assure good electrical and mechanical interengagement between the contact tabs 56 and the respective flanges 46, 48.

I claim:

1. In combination with an electrical connector having a housing of rigid insulative material defining a mating face, an oppositely directed terminating portion, a plurality of terminal passages extending between said mating face and said terminating portion, and a transverse slot intersecting each said passage, a plurality of electrical terminals each mounted in a respective passage, each terminal having a mating portion directed towards said mating face and a conductor engaging portion accessible in said terminating portion and a retention portion including a pair of closely spaced flanges extending normal to the axis of the terminal and lying in said transverse aperture, a means to common selected terminals of said connector characterized by an elongated strip of conductive material having a plurality of regularly spaced tabs extending normal to the plane of said strip, each said tab being receivable between said pairs of flanges of respective ones of said terminals whereby by application of said strip and said tabs selected terminals can be interconnected.

2. The combination according to claim 1 wherein each said tab is further characterized by at least one dimple extending from the plane of said tab to better engage said flanges of a respective terminal.

3. The combination according to claim 1 wherein said commoning strip is further characterized by means to grippingly secure the strip to said connector housing.

4. The combination according to claim 3 wherein said means to grippingly secure said strip is characterized by a profile on one marginal edge of said strip which bitingly engages said connector housing and at least one latching tab depending from the other marginal edge of said strip engaging another portion of said connector housing.

* * * * *